US006448994B1

(12) United States Patent
Kim et al.

(10) Patent No.: US 6,448,994 B1
(45) Date of Patent: Sep. 10, 2002

(54) LASER PRINTER

(75) Inventors: Kyung-hwan Kim; Ki-ju Park, both of Kyungki-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/901,056

(22) Filed: Jul. 10, 2001

(30) Foreign Application Priority Data

Aug. 25, 2000 (KR) ..... 2000-49691

(51) Int. Cl.[7] ..... B41J 2/435; G03G 15/00; G03G 15/02

(52) U.S. Cl. ..... 347/228; 399/107; 399/116; 399/117

(58) Field of Search ..... 347/228; 399/107, 399/110, 111, 114, 116, 117

(56) References Cited

U.S. PATENT DOCUMENTS 6,075,958 A * 6/2000 Gotoh et al. ..... 399/124

* cited by examiner

*Primary Examiner*—Michael Nghiem
(74) *Attorney, Agent, or Firm*—Sughrue Mion, PLLC

(57) ABSTRACT

A laser printer including a printer main body having a mounting portion exposed by opening a front door which is mounted on a front side of the printer main body; a side door unit mounted on a side of the printer main body to be opened and closed and rotatably supporting a transfer roller; a developing unit removably mounted in the mounting portion and having a photosensitive drum in contact with the transfer roller when mounted in the mounting portion and an opening for exposing the photosensitive drum to the external environment; an interlock device for preventing the mounted developing unit from being; removed from the mounting portion when the side door unit is closed; and a shutter device associated in operation with the interlock device to close the opening when the side door unit is opened, and expose the opening when the side door unit is closed.

9 Claims, 6 Drawing Sheets

LASER PRINTER

BACKGROUND OF THE INVENTION

1. Field of the Invention

The present invention relates to a laser printer and, more particularly, to a laser printer capable of protecting a photosensitive drum when handling and replacing printer components.

2. Description of the Related Art

Generally, as shown in FIG. 1, a laser printer includes a developing unit 2 and a toner cartridge 3 which are removably mounted on the front of the printer main body 1. The developing unit 2 has a photosensitive drum 2*a*. When the developing unit 2 is mounted on the printer main body 1, the photosensitive drum 2*a* is rotatably contacted with a transfer roller 4*a*. The transfer roller 4*a* is supported by a side door unit 4 which is mounted on one side of the printer main body 1 to be opened and closed for an easier removal of jammed paper and an easier replacement of the components.

In the above structure, the front surface of the photosensitive drum 2*a* is evenly charged by an electrostatic charge roller (not shown). An electrostatic latent image is formed on the surface of the charged photosensitive drum 2*a* by the light scanned from a laser scanning unit 5. Toner is supplied from the toner cartridge 3 and attached on the electrostatic latent image, visualizing the latent image into a preliminary image. A sheet of printing paper is picked up by a pickup unit 7 from a paper cartridge 6, and passed between the transfer roller 4*a* and the photosensitive drum 2*a*. While the printing paper is passed between the transfer roller 4*a* and the photosensitive drum 2*a*, the preliminary image is transferred on the printing paper. The toner on the printing paper is fixed by a fixing unit 8 while the sheet of paper is passed through a fixing unit 8. After passing the fixing unit 8, the sheet of printing paper is delivered to a stacker via certain routes.

In the meantime, in a printer operated as stated above, for maintenance of the internal components, cleaning, repair, replacement, and so on, the developing unit 2 should be separated from the printer main body 1. For this, a front door (not shown) mounted on the front of the printer main body 1 is opened, thus opening a mounting portion 1*a*. Then the developing unit 2 is taken out from the mounting portion 1*a*. If the side door unit 4 is closed, however, since the transfer roller 4*a* and the photosensitive drum 2*a* are in a contact with each other, there is a problem in that the photosensitive drum 2*a* is scratched by the transfer roller 4*a* while the developing unit 2 is taken out from the mounting portion 1*a*. This is inconvenient because certain precautionary steps are required of a user when detaching the developing unit 2. Further, the photosensitive drum 2*a* may be damaged by the carelessness of a user.

Furthermore, in the event that the side door unit 4 is opened, as indicated by the bi-directional arrow ill FIG. 1 while the developing unit 2 is mounted on the printer body 1, the photosensitive drum 2*a* is exposed through an opened side of the printer main body 1. Accordingly, the life span of the photosensitive drum 2*a* is shortened since the surface of the photosensitive drum 2*a* is directly exposed to external light. Accordingly, when opening the side door unit 4, it is desirable to shield the photosensitive drum 2*a* from external light rays. In addition, the photosensitive drum 2*a* should not be exposed to the external environment, and it is desirable to prevent the photosensitive drum 2*a* from being damaged due to a user's carelessness.

SUMMARY OF THE INVENTION

The present invention has been made to solve the above problems, and accordingly, it is an object of the present invention to provide a laser printer having an improved structure capable of preventing an exposure of a photosensitive drum when a side door unit is opened, and also preventing the removal of a developing unit when a side door unit is closed.

The above object is accomplished by a laser printer according to the present invention, including a printer main body having a mounting portion opened by a front door which is mounted on the front side of the printer main body to be opened and closed; a side door unit mounted on a side of the printer main body to be opened and closed, for rotatably supporting a transfer roller; a developing unit removably mounted in the mounting portion when the front door is opened, the developing unit having a photosensitive drum in contact with the transfer roller when mounted in the mounting portion, and an opening for exposing the photosensitive drum to the external environment; an interlock means for preventing the developing unit from being separated from the mounting portion when the side door unit is closed; and a shutter means associated in operation with the interlock means, for closing the opening when the side door unit is opened and opening the opening when the side door unit is closed.

The interlock means includes a sliding member mounted on the printer main body in order to reciprocate between a blocking position in which the sliding member protrudes in an entrance of the mounting portion and a release position in which the sliding member is withdrawn from the entrance of the mounting portion. The, the developing unit may be freely removed from the mounting portion only when the sliding member is withdrawn from the entrance of the mounting portion. The sliding member is moved to the blocking position by being pushed by the side door unit which is coupled to the printer main body. The interlock means also includes a pressing spring for elastically pressing the sliding member to the release position.

The shutter means includes a shutter mounted on an outer side of the developing unit to be moved upward and downward, for selectively opening and closing the opening; a pivoting unit for exposing the opening by moving the shutter downward while pivoted by the side door unit mounted to the printer main body, one end of the pivoting unit being hinged to the shutter, while the other end of the same being hinged to a side of the developing unit; and a pressing spring, for elastically pressing the shutter or the pivoting unit in order for the shutter to close the opening.

A guide member is provided for guiding an upward and a downward movement of the shutter. The guide member includes a guide groove formed around the opening of the developing unit in a generally vertical direction; and a guide protrusion formed on an end of the shutter to slide in the guide groove.

The shutter means includes a pivoting member mounted on the printer main body to reciprocate therein according to the movement of the sliding member, being protruded to an entrance of the mounting portion or withdrawn from the entrance of the mounting portion; a shutter mounted on an outer side of the developing unit to be moved upward and downward, for selectively opening and closing the opening; a pivoting unit for lowering the shutter while being pivoted by the pushing of the pivoting member protruding in the entrance of the mounting portion, one end of the pivoting unit being connected to the shutter, and the other end of the pivoting unit being hinged to a side of the developing unit; and a pressing spring for elastically pressing the shutter or the pivoting unit upward in order for the shutter to close the opening that exposes the photosensitive drum.

The pivoting unit includes a pivoting bracket elastically biased in a direction of pushing the shutter by the pressing spring, one end of the pivoting bracket being pivotably mounted on a side of the developing unit, and the other end of the pivoting bracket having a contact protrusion to be in contact with a pivoting lever; and a connection wire with one end hinged to a side end of the shutter and the other end fixed to the pivoting bracket.

The sliding member includes a slot formed on one end thereof for guiding the movement of the pivoting member, and the pivoting member includes a guide protrusion connected to the slot.

BRIEF DESCRIPTIONS OF THE DRAWINGS

The above object and other advantages of the present invention will become more apparent by describing in detail a preferred embodiment thereof with reference to the attached drawings, in which.

DETAILED DESCRIPTION OF THE PREFERRED EMBODIMENTS

Figure 1:
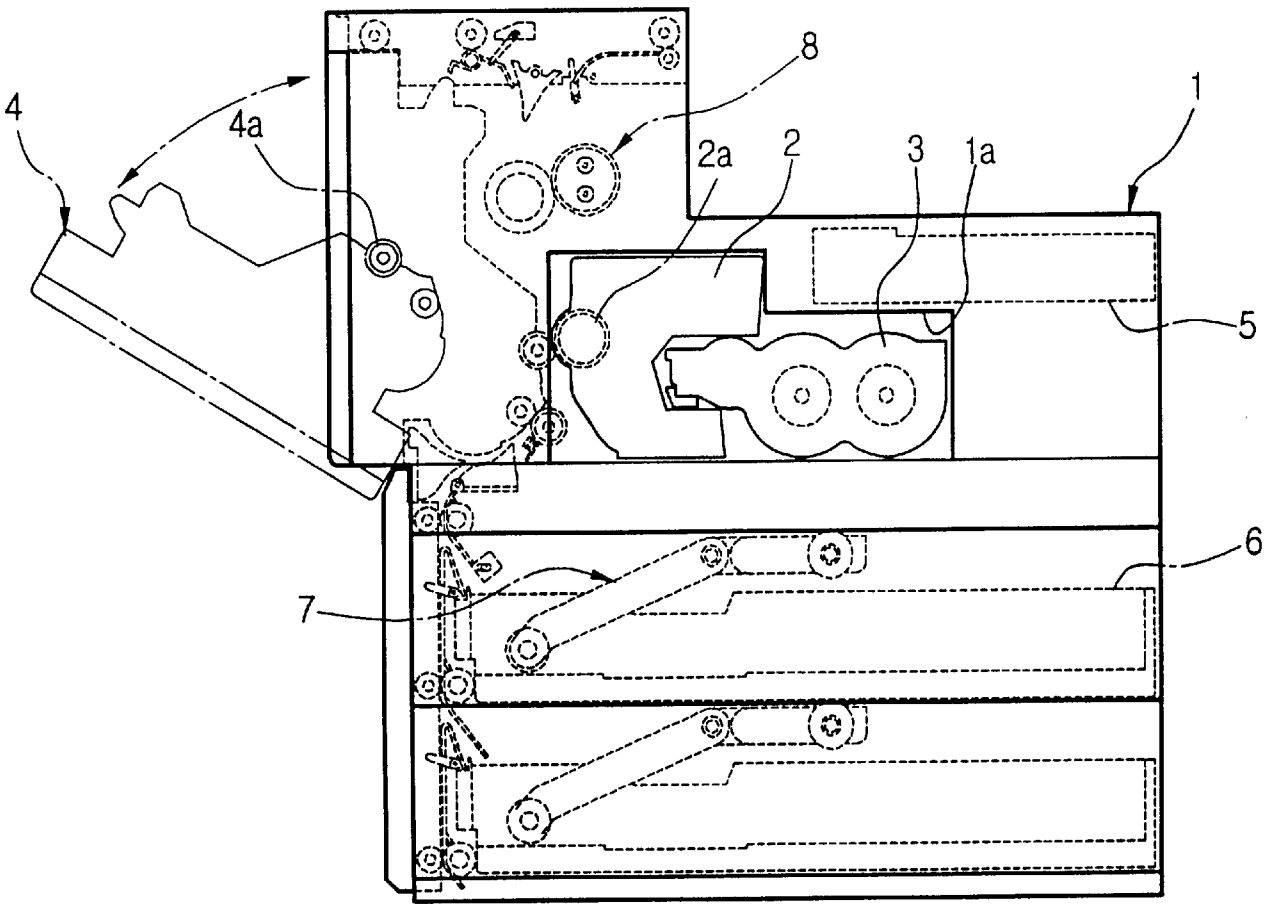
FIG. 1 (PRIOR ART)
FIG. 1 is a view schematically showing a general laser printer.
Figure 2:
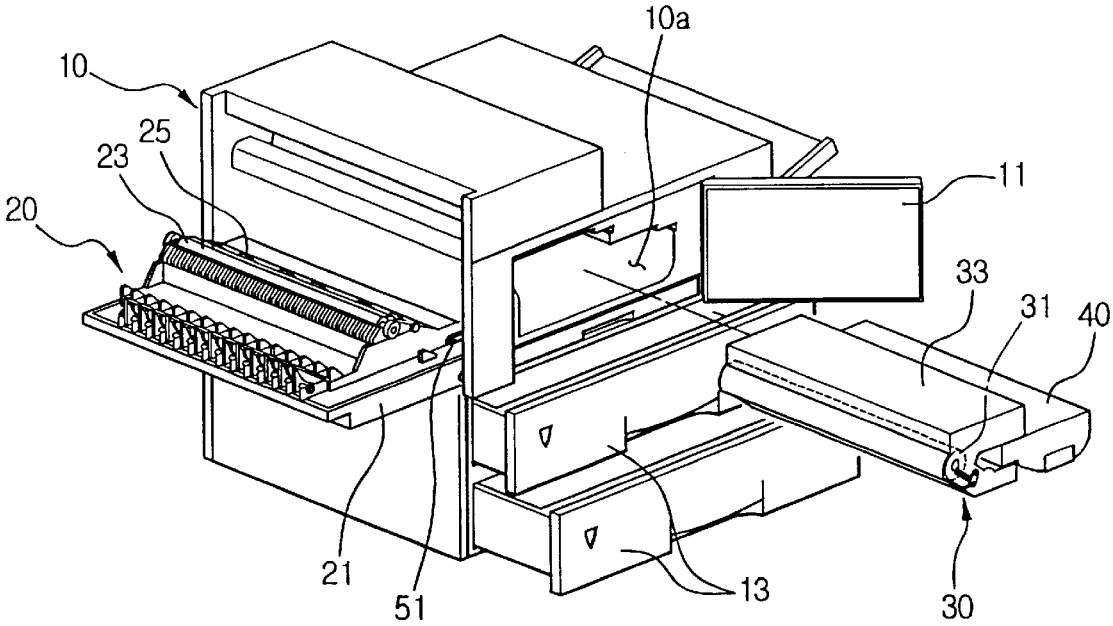
FIG. 2 is a perspective view showing a laser printer according to an embodiment of the present invention.

Referring to FIG. 2, a laser printer according to an embodiment of the present invention includes a printer main body 10 having a mounting portion 10*a* accessed through an opening in a front side of the printer main body 10, a side door unit 20 mounted on one side of the printer main body 10 to be opened and closed, a developing unit 30 removably mounted in the mounting portion 10*a,* and an interlock means and a shutter means for preventing the developing unit 30 from being removed from the mounting portion 10*a* when the side door unit 20 is closed.

A front door 11 is mounted on the front of the printer main body 10 for exposing and concealing the mounting portion 10*a.* A toner cartridge 40 is removably mounted in the mounting portion 10*a* together with the developing unit 30 for supplying toner to the developing unit 30. Further, paper cassettes 13 are disposed below the mounting portion 10*a* for accommodating printing paper.

The side door unit 20 includes a door bracket 21 of which a lower portion is hinged to the printer main body 10 to open and close the side door unit 20 on one side of the printer main body 10, a transfer roller 23 and a paper-feeding roller 25 rotatably mounted on the door bracket 21. When the side door unit 20 is closed, the transfer roller 23 is in contact with a photosensitive drum 31 of the developing unit 30 which is mounted in mounting portion 10*a*. The respective sheets of printing paper are passed between the transfer roller 23 and the photosensitive drum 31.

Figure 3:
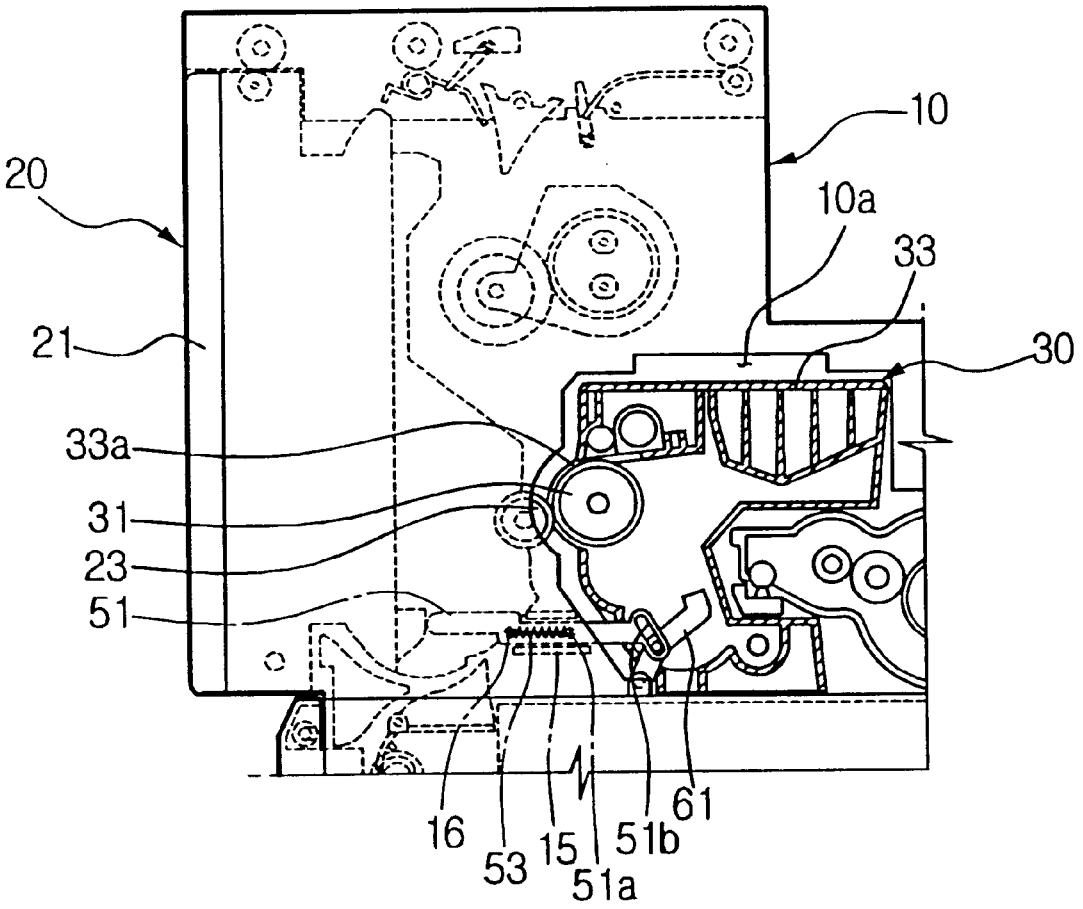
FIG. 3 is a partially cross-sectioned view showing main parts of the embodiment depicted in FIG. 2.

A complementary coupled developing unit 30 and a toner cartridge 40 is coupled to the mounting portion 10*a*. The developing unit 30 includes the photosensitive drum 31 for forming an electrostatic latent image by light scanned by a laser scan unit (not shown), and a developing base body 33 rotatably supporting the photosensitive drum 31. The developing base body 33, as shown in FIG. 3, has an opening 33*a*. If the opening 33*a* is opened, the photosensitive drum 31 is exposed to the external environment, and contacted with the transfer roller 23. That is, when the developing unit 30 is mounted in the mounting portion 10*a,* by closing the side door unit 20, the photosensitive drum 31 comes into a contact with the transfer roller 23 in a rotatable manner.

The interlock means, as shown in FIG. 3, includes a sliding member 51 slidably mounted on the printer main body 10, and a pressure spring 53. The sliding member 51 moves between a blocking, position, as shown in FIG. 3, when it protrudes in an entrance of the mounting portion 10*a,* and a release position, as shown in FIG. 2, when it is withdrawn from the entrance of the mounting portion 10*a*. When the sliding member 51 is located at the release position, the developing unit 30 can be freely mounted in and removed from the mounting portion 10*a*. The sliding member 51 is moved to the blocking position when pushed by the side door unit 20 coupled to the print main body 10 as occurs when the side door unit 20 is closed.

Further, a slot 51*b* is formed on one end of the sliding member 51 in order to guide a pivoting member 61 which will be described later. The slot 51*b* is disposed at a predetermined angle with respect to the direction in which the sliding member 51 moves. Yet still further, a guide rail 15 is provided on the printer main body 10 for guiding the movements of the sliding member 51. One end of the pressure spring 53 is connected to a fixture pin 16 of the printer main body 10 while the other thereof is connected to a support pin 51*a* of the sliding member 51, to thereby clastically press the sliding member 51 to the release position. Accordingly, as shown in FIG. 2, en the side door unit 20 is opened, the sliding member 51 is withdrawn from the entrance of the mounting portion 10*a,* enabling the mounting and removal of the developing unit 20 in and from the mounting portion 10*a*.

Figure 4:
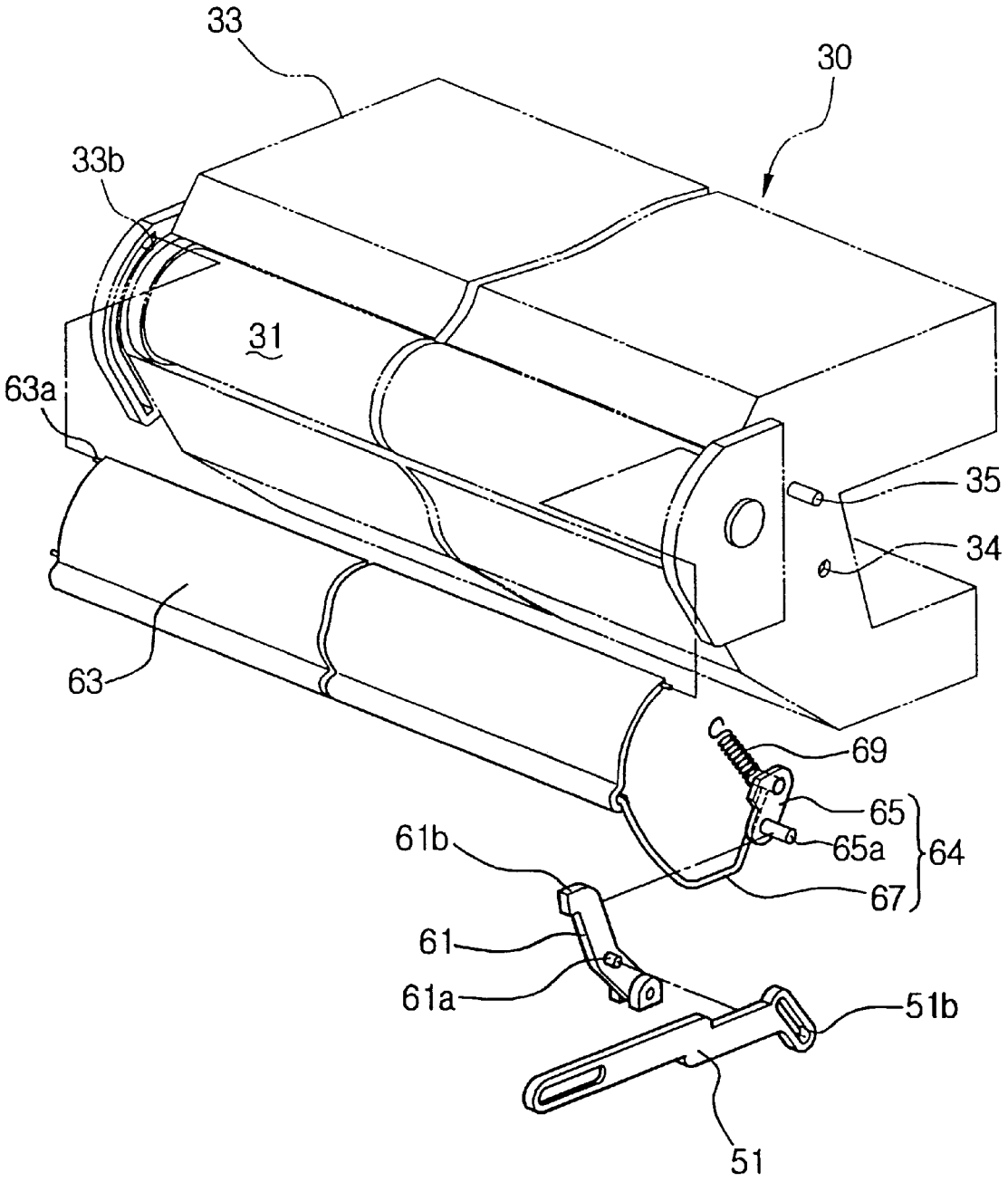
FIG. 4 is an exploded perspective view showing a developing unit of the embodiment depicted in FIG. 2.
Figure 5:
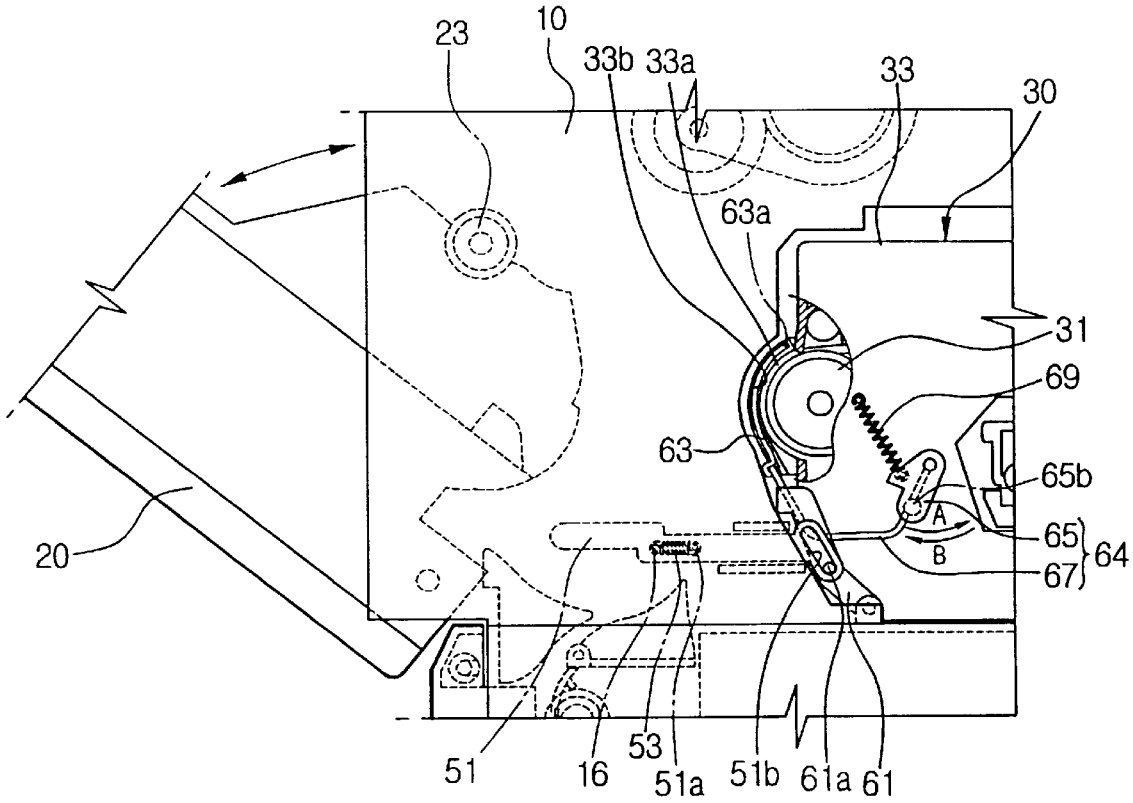
FIG. 5 is a view showing a developing unit being mounted and a side door unit being opened.

As shown in FIGS. 4 and 5, the shutter means includes a pivot member 61 mounted on the printer main body 10 to be pivotally interlocked with the sliding member 51, a shutter 63 for opening and closing the opening 33*a* of the developing base body 33, a pair of pivoting units 64 pivotally mounted on the sides of the developing base body 33 for moving the shutter 63 up and down, and a pressing spring 69.

One end of the pivoting member 61 is hinged to the printer main body 10, while the center portion thereof has a guide protrusion 61*a* coupled to the slot 51*b* of the sliding member 51. The pivoting member 61 protrudes in, or is withdrawn from, the entrance of the mounting portion 10*a* according to the movement of the sliding member 51.

The shutter 63 is mounted on the exterior of the developing base body 33 to be moved by a guide means upward and downward and accordingly open and close the opening 33*a*. The guide means has a guide groove 33*b* formed around the opening 33*a* of the developing base body 33 and a guide protrusion 63*a* formed on both sides of the upper portion of the shutter 63.

The pivoting units 64 have a pivoting bracket 65 and a connection wire 67 connecting the pivoting bracket 65 and the shutter 63, respectively. One end of the pivoting bracket 65 is hinged to a connection hole 34 formed in a side of the developing base body 33, while the other end thereof has a contact protrusion 65*a* in contact with the pivoting member 61. When the pivoting member 61 protrudes in the entrance of the mounting portion 10*a,* as shown for example in FIG. 6, the contact protrusion 65*a* is pushed by the free end 61*b* of the pivoting member 61, so that the pivoting bracket 65 is pivoted in a direction as indicated by arrow A in FIG. 5.

Further, when the pivoting member 61 returns to the position shown in FIG. 5, the pivoting bracket 65 also returns in the direction indicated by arrow B due to the pressing spring 69. The connection wire 67 connects and supports the pivoting bracket 65 and the shutter 63. One ends of the connection wires 67 are hinged to the lower sides of the shutter 63 while the other ends thereof are fixed to the pivoting bracket 65. Accordingly, the connection wires 67 pivotably reciprocate together with the pivoting bracket 65, moving the shutter 63 upward and downward.

One end of the pressing spring 69 is connected to the pivoting bracket 65, while the other end thereof is connected to a support pin 35 provided on a side of the developing base body 33. The pressing spring 69 elastically urges the pivoting bracket 65 and the connection wires 67 in the direction of arrow B. Thus, the shutter 63 closes the opening 33*a* if the pivoting member 61 and the contact protrusion 65*a* become separated.

Operations of a laser printer having the structure according to the foregoing embodiment of the present invention will now be described.

As shown in FIG. 3, when the side door unit 20 of the printer is closed, the transfer roller 23 is in contact with the photosensitive drum 31. Further, the sliding member 51, which is pushed by the side door unit 20, is located in the breaking position. That is, the sliding member 51 protrudes in the entrance of the mounting portion 10*a*. In this state, the developing unit 30 can not be removed from the mounting portion 10*a* because the developing unit 30 is confined to the sliding member 51. Accordingly, unlike the conventional laser printer, when the photosensitive drum 31 is in contact with the transfer roller 23, the present invention prevents the developing unit 30 from being inadvertently taken out of the mounting portion 10*a*.

Figure 6:
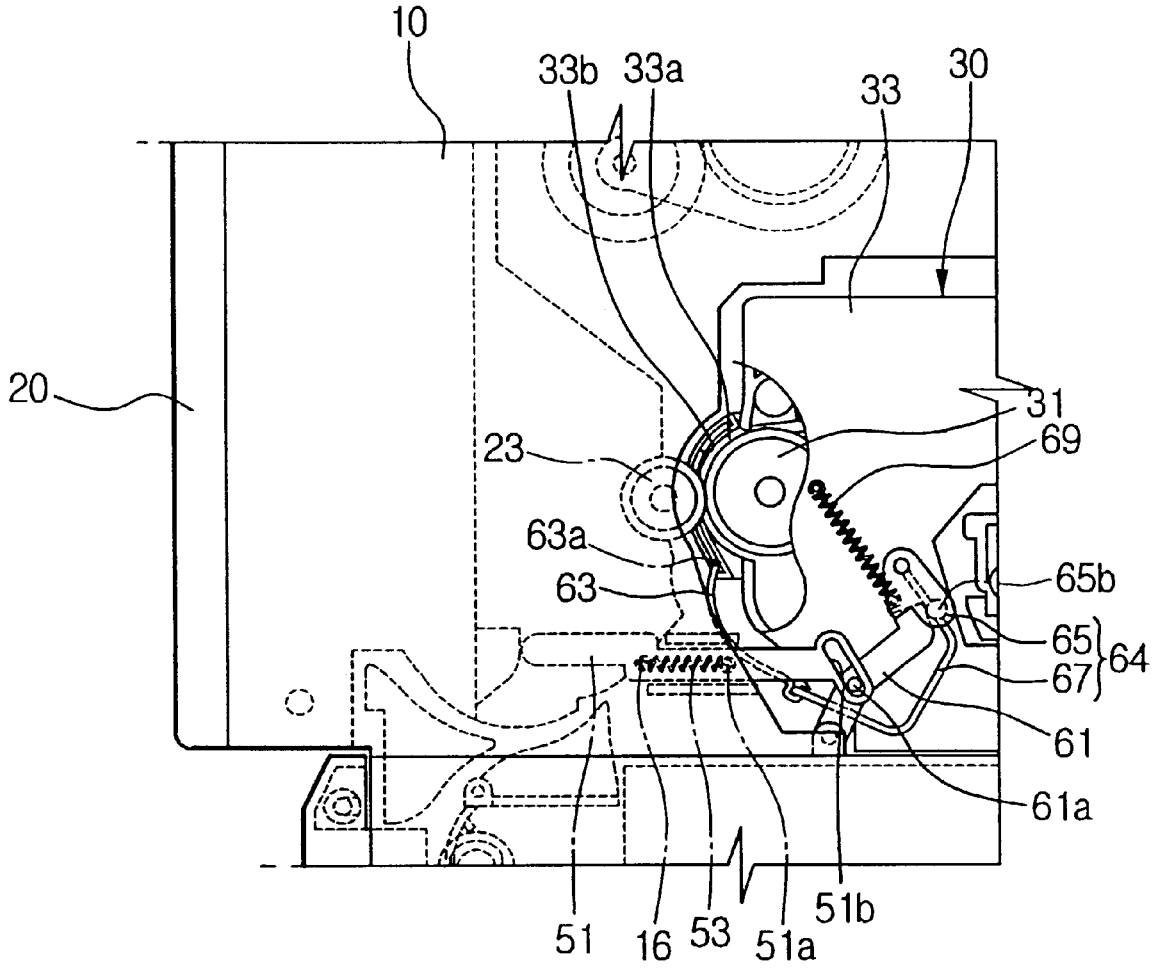
FIG. 6 is a view of the developing unit depicted in FIG. 5 showing the side door unit closed.

Further, the pivoting member 61 is pushed by the sliding member 51 to protrude in the entrance of the mounting portion 10*a* and thus aids in impeding the removal of the developing unit 30 from the mounting portion 10*a*. In addition, as shown in FIG. 6, when the pivoting member 61 protrudes in the entrance of the mounting portion 10*a,* the pivoting unit 64 is completely pushed in the direction of arrow A by the pivoting member 61. Furthermore, since the shutter 63 connected to the connection wires 67 is moved downward under those conditions, the opening 33*a* of the developing base body 33 is exposed. Accordingly, the photosensitive drum 31 and the transfer roller 23 are in contact through opening 33*a* when it is exposed.

If a sheet of paper is jammed during the printing process, the side door unit 5 should be opened to remove the jammed paper. For this purpose, as shown in FIG. 5, when the side door unit 20 is opened, the transfer roller 23 and the photosensitive drum 31 are separated from each other. In addition, the side door unit 20 no longer pushes the sliding member 51 to the blocking position. Thus, when the side door unit 20 is opened, the sliding member 51 is moved to the release position due to an elastic force of the pressing spring 53. In this state, the sliding member 51 no longer protrudes from the entrance of the mounting portion 10*a*. At the same time, when the sliding member 51 is in the release position, the pivoting member 61 is pivoted by the sliding member 51 and withdrawn from the entrance of the mounting portion 10*a*.

As the pivoting member 61 moves out of the mounting portion 10*a,* the pivoting bracket 65 and the connection wires 67, previously moved in the direction of arrow A by the pivoting member 61, are pivoted in the direction of arrow B by the pressure of the pressing spring 69. Accordingly, the shutter 63 connected to the ends of the connection wires 67 slides upward at the urging of the connection wires 67 which are moved in the direction of arrow B.

As the shutter 63 slides upward, the shutter 63 shields the opening 33*a* and thus protects the developing, base body 33 from outside environment. In this manner, the photosensitive drum 31 is shielded from the external environment by the shutter 63. The opening of the side door unit 20, the movement of the sliding member 51, the turning of the pivoting member 61 and the pivoting units 64, and the movement of the shutter 63 are performed together. Accordingly, the degree to which the photosensitive drum 31 is exposed varies depending on how far the side door unit 20 is opened.

If the side door unit 20 is opened to a large degree, the shutter 63 is completely lifted to entirely close the opening 33*a,* and the sliding member 51 is completely moved to the release position. In this state, the developing unit 30, as shown in FIG. 2, can be removed from the mounting portion 10*a*. Further, when the developing unit 30 is removed from the mounting portion 10*a,* the photosensitive drum 31 is separated from the transfer roller 23 and shielded by the shutter 63 from the external environment including harmful direct light rays. In this manner, damage to the photosensitive drum 31 is prevented when the developing unit 30 is removed from or inserted in the mounting portion 10*a*.

While the present embodiment takes an example in which the pivoting units 64 are pivotally mounted by being pushed by the pivoting member 61, in another embodiment, the pivoting units 64 are constructed to be directly pivoted by the side door unit 20. In this case, a protrusion bar for contacting and-pressing the pivoting units 64 may be mounted on the side door unit 20 to protrude in the mounting portion 10*a*.

With the laser printer according to the present invention as described above, the developing unit 30 is not separated from the printer main body 10 when the transfer roller 23 and the photosensitive drum 31 are in contact to each other. Accordingly, damage to the photosensitive drum 31 due to a user's carelessness is prevented.

Further, when the side door unit 20 is opened or the developing unit 30 is removed from the printer main body 10, the shutter 63 is mounted to operate in association with an interlock means and thus prevent the photosensitive drum 31 from being exposed to the external environment. Accordingly, the photosensitive drum may be safely protected from direct light rays and so on.

Furthermore, since the interlock means and the shutter 63 are mechanically connected to each other and operated in association with one another, additional advantages are realized in that redundant structure is avoided and the overall structure is simplified. Thus, the present invention is an advantageous design.

Although the preferred embodiment of the present invention has been described, it will be understood by those skilled in the art that the present invention should not be limited to the described preferred embodiment. Rather, various changes and modifications can be made within the spirit and scope of the present invention as defined by the appended claims.

What is claimed is:

1. A laser printer, comprising:

a printer main body having a mounting portion covered by a front door which is mounted on a front side of the printer main body, said front door having an opened position exposing the mounting portion and a closed position concealing the mounting portion;

a side door unit mounted on a side of the printer main body and having an opened position and a closed position, said side door unit rotatably supporting a transfer roller;

a developing unit removably mounted in the mounting portion, the developing unit having a photosensitive drum in contact with the transfer roller when mounted in the mounting portion, and an opening for exposing the photosensitive drum to an external environment;

an interlock means for preventing the developing unit from being removed from the mounting portion when the side door unit is in said closed position; and a shutter means associated in operation with the interlock means, said shutter means closing the opening when the side door unit is in said opened position and said shutter means exposing the opening when the side door unit is in said closed position.

2. The laser printer as claimed in claim 1, wherein the interlock means includes:

a sliding member mounted on the printer main body and reciprocating between a blocking position in which the sliding member protrudes in an entrance of the mounting portion and a release position in which the sliding member is withdrawn from the entrance of the mounting portion, the side door unit pushing the sliding member to the blocking position; and a pressing spring for elastically urging the sliding member to the release position.

3. The laser printer as claimed in claim 2, wherein the shutter means includes:

a pivoting, member mounted on the printer main body to reciprocate therein according to the movement of the sliding member, said pivoting member protruding in an entrance of the mounting portion when said sliding member is in said blocking, position and being withdrawn from the entrance of the mounting portion when said sliding member is in said release position;

a shutter mounted on an outer side of the developing unit, said shutter moving upward to expose the opening and downward to close the opening;

a pivoting unit being pushed by the pivoting member when the pivoting member protrudes in the entrance of the mounting portion, the pivoting unit lowering the shutter when pushed by the pivoting member, one end of the pivoting unit being connected to the shutter, and an other end of the pivoting unit beings hinged to a side of the developing unit; and a pressing spring elastically pressing the shutter or the pivoting unit upward to close the opening.

4. The laser printer as claimed in claim 3, wherein the pivoting unit includes:

a pivoting bracket elastically biased by the pressing spring to push the shutter, one end of the pivoting bracket being pivotably mounted on a side of the developing unit, and an other end of the pivoting bracket having a contact protrusion in contact with a pivoting lever; and a connection wire, one end of the connection wire being hinged to a side end of the shutter and an other end of the connection wire being fixed to the pivoting bracket.

5. The laser printer as claimed in claim 3, wherein the sliding member includes a slot defined by one end of said sliding member, said sliding member guiding the movement of the pivoting member, and the pivoting member includes a guide protrusion inserted in the slot.

6. The laser printer claimed in claim 1, wherein the shutter means includes:

a shutter mounted on an outer side of the developing unit, said shutter moving upward closing the opening and downward exposing the opening;

a pivoting unit having a one end hinged to the shutter and an other end hinged to a side of the developing unit, said pivoting unit being pivoted by the side door unit to move the shutter downward; and a pressing spring elastically pressing the shutter or the pivoting unit so that the shutter closes the opening.

7. The laser printer as claimed in claim 6, further comprising a guide member for guiding an upward and a downward movement of the shutter.

8. The laser printer as claimed in claim 7, wherein the guide member includes:

a guide groove formed around the opening, of the developing unit; and a guide protrusion formed on an end of the shutter to slide in the guide groove.

9. A laser printer, comprising:

a printer main body having a mounting portion covered by a front door which is mounted on a front side of the printer main body, said front door having an opened position exposing the mounting portion and a closed position concealing the mounting portion;

a side door unit mounted on a side of the printer main body and having an opened position and a closed position, said side door unit rotatably supporting a transfer roller;

a developing unit removably mounted in the mounting portion, the developing unit having a photosensitive drum in contact with the transfer roller when mounted in the mounting portion, and an opening for exposing the photosensitive drum to an external environment;

an interlock mechanism which prevents the developing unit from being removed from the mounting portion when the side door unit is in said closed position; and a shutter mechanism associated in operation with the interlock mechanism, said shutter mechanism closing the opening when the side door unit is in said opened position and said shutter mechanism exposing the opening when the side door unit is in said closed position.

* * * * *